US008011038B2

(12) United States Patent
Balasundharam

(10) Patent No.: US 8,011,038 B2
(45) Date of Patent: Sep. 6, 2011

(54) DETACHABLE AND CHANGEABLE HEM

(76) Inventor: Sri Hari Prasadh Balasundharam, Coimbatore (IN)

( * ) Notice: Subject to any disclaimer, the term of this patent is extended or adjusted under 35 U.S.C. 154(b) by 0 days.

(21) Appl. No.: 12/794,425

(22) Filed: Jun. 4, 2010

(65) Prior Publication Data

US 2010/0306920 A1 Dec. 9, 2010

(51) Int. Cl.
*A47G 9/04* (2006.01)

(52) U.S. Cl. ..... 5/496; 5/482; 5/486

(58) Field of Classification Search ..... 5/482, 496, 5/485–486, 500–502
See application file for complete search history.

(56) References Cited

U.S. PATENT DOCUMENTS 2,139,980 A 12/1938 Simon
3,273,176 A 9/1966 Millar
4,631,765 A * 12/1986 Casey ..... 5/417
4,890,347 A 1/1990 Fuller
5,118,553 A 6/1992 Boisson
5,628,064 A 5/1997 Chung
5,836,023 A * 11/1998 Stone Munson ..... 5/482
6,105,186 A 8/2000 Stone Munson

* cited by examiner

*Primary Examiner* — Fredrick Conley
(74) *Attorney, Agent, or Firm* — Alix, Yale & Ristas, LLP

(57) ABSTRACT

The present disclosure relates to a method of providing different types of hems/flanges on the base sheet of the bed sheets or pillow cases or duvets or shams to provide variety and options. More specifically the present invention relates to a method of making a "hem"/"flange" with or without design elements, separately and attaching the said hem/flange to the base sheet of the bed sheet or pillow cases, duvet covers, shams etc by means of zippers, snap buttons, regular buttons, etc.

12 Claims, 5 Drawing Sheets

DETACHABLE AND CHANGEABLE HEM

FIELD OF INVENTION

The present disclosure relates to a method of providing different types of hems/flanges on the base sheet of the bed sheets or pillow cases or duvets or shams to provide variety and options. More specifically the present disclosure relates to a method of making a "hem"/"flange" with or without design elements, separately and attaching the said hem/flange to the base sheet of the bed sheet or pillow cases, duvet covers, shams etc. Thus the present disclosure is capable of providing an interchangeable hem/flange that can be attached to or removed from the base sheet of the bed sheet or pillow cases, duvet covers, shams etc. by means of zippers, snap buttons, regular buttons, etc. The disclosure thereby provides the option of using different types of "hems"/"flanges" on the base sheet of the bed sheets or pillow cases (or duvets or shams) on the same bed sheet to provide variety and options which is cost effective and less time consuming process. Advantageously the present disclosure is simple and easy to use.

BACKGROUND ART

Bed sheets, pillow cases, duvet covers, shams are available in different forms made of different types of material. They are very functional providing a good night sleep but also compliment the decoration of the bed room through the design, color and construction.

The top portions of a bed sheet is usually folded and hemmed in a slightly decorative manner to give the design element to the bed sheet. This portion is also commonly referred to as the "Hem" of the sheet. Similarly, the pillow cases that go with these sheets also have a "hem portion" which is usually the same as the bed sheet or could be slightly different but to complement the bed sheet. The duvet covers and shams may have a slightly more elaborate design element as they are usually considered "Top of Bed" and many times used to decorate the bed. The attachment/design element is done over the product and is referred as "flange".

There are various ways of achieving this design element. Normally design is added by "printing" a design with different colors on the fabric. On some bed sheets (mainly in high end luxurious products), the bed sheets are just plain (dyed in a single color).

A very simple hem can be obtained by folding the fabric back into itself (over about 4") and then using a simple single needle stitch to keep it together. Such a Hem is called a "Single Needle Hem" as depicted in FIG. 1(*a*) and FIG. 2(*a*). A similar process using a double needle stitch is called "Double Needle Hem" as depicted in FIG. 1(*b*) and FIG. 2(*b*). These hems can be done either by folding the fabric inwards or outwards. If the face and the back of the fabric are visually different, this also adds a small design element to the sheet.

Apart from these simple hems, there are other very intricate and detailed hems—a common one is done by using a "Picotting machine". This hem consists of tiny holes at the joining area and gives a very rich look to the fabric. This hem is commonly referred to as the "Hem Stitch". Again this "Hem Stitch" can be done in one or more rows, thus deriving "Two-Row Hem Stitch", "Three-Row Hem Stitch" etc.

Other forms of more intricate hems include a "Satin Stitch" also sometimes referred to as a "Baratto Stitch" or a "Merrow Stitch". This is made usually on an embroidery machine or a special purpose machine by stitching zigzag threads very closely to give it that affect. This "Satin Stitch" can also be extended into two rows, three rows etc or varying widths to give different options.

Apart from this, embroidery of other forms is commonly used to add a design element to the hem of the sheet. Slightly more elaborate designs include attaching a different colour fabric as the hem portion to give a contrast effect as depicted in FIG. 1(*c*) and FIG. 1(*d*). All these different options give a design element to the bed sheet.

Similarly, the pillow cases that go with these sheets also have a "hem portion" which is usually the same as the bed sheet or could be slightly different but to complement the bed sheet as depicted in FIG. 2(*a*), FIG. 2(*b*), FIG. 2(*c*) and FIG. 2(*d*).

The duvet covers and shams may have a slightly more elaborate design element as they are usually considered "Top of Bed" and many times used to decorate the bed. They are usually attached over the product and are also referred as "flange" as shown in FIG. 3(*a*), FIG. 3(*b*) and FIG. 3(*c*).

Some attempts have been made in the past to deal with overcoming the stated limitations of the prior art such as those disclosed in the following:

U.S. Pat. No. 5,836,023 titled 'Decorative trim strip for comforters, quilts, and the like' discloses a bed clothing arrangement including a bed covering, a decorative trim strip made of flexible decorative material, and fastening means for removably fastening the decorative trim strip to the bed covering. U.S. Pat. No. 6,105,186 discloses a reversible multi-layer decorative trim which is particularly suited for use with bedclothes or bed coverings such as comforters and quilts comprising a bed covering, a reversible decorative trim strip made of multiple layers of flexible decorative materials, and fastening means for removably fastening the decorative trim strip to the bed covering. U.S. Pat. No. 5,628,064 disclosed separable clothes including a base panel for covering a part of the body, and a plurality of auxiliary panels detachably fastening to one another or to the base panel by zippers, hook and loop materials, and snaps for covering the limbs or a part of the body. U.S. Pat. No. 2,139,980 disclosed a comforter with a detachable valance that makes it a bed spread. The valance can be decorative and is attached during the day time to make it look like a bed spread and during the night it is removed to be used as a comforter wherein the attachment is by means or a zipper or hook etc. U.S. Pat. No. 3,273,176 relates to a detachable flap for a blanket that can be disposable or washable for hygiene purposes. U.S. Pat. No. 4,890,347 describes an interchangeable detachable decorative applique which is a piece of art work made of fabric attached to top of comforter, bedspread or other bed covering. U.S. Pat. No. 5,118,553 relates to a bed covering that has connectable panels which are connected at overlapping borders by complementary fasteners.

Thus, in order to have a different look/appearance, the only possibility is to change the entire sheet or Top of Bed. Hence to change the look of the bed, the only option is to change the entire sheets even if it is still clean or entirely usable. It is desirable to be able to change the look of the bed frequently without having to change the entire bed linen.

There has thus been a need in the art to develop a simple, cost effective and less time consuming method that would be capable of providing different types of hems on the bed sheets or pillow cases or duvets or shams on the same bed sheet providing variety and options to suit the room. Various other features and method of the present disclosure will become obvious to those skilled in the art upon reading the disclosure set forth hereinafter.

OBJECTS OF THE DISCLOSURE

The basic object of the present disclosure is thus directed to a method of providing different types of hems/flanges with or without design elements on the base sheets of the bed sheets or pillow cases or duvets or shams to provide variety and options.

Another object of the present disclosure is directed to a method of making a "hem"/"flange" separately and attaching the said hem/flange to the base sheet of the bed sheet or pillow cases, duvet covers, shams etc.

It is further object of the present disclosure to provide a method for introducing a design element wherein the "hem"/"flange" portion and the based sheets are constructed separately.

A still further object of the present disclosure is directed to a method of providing an interchangeable hem/flange, wherein the hem/flange can be attached to or removed from the base sheet of the bed sheet or pillow cases, duvet covers, shams etc. by means of zippers, snap buttons, regular buttons, etc.

It is still another object of the present disclosure to provide a method of introducing the hem/flange for each base sheet thereby providing multiple hem/flange attachments including color options, embroidery options etc and any of these can be attached with the base sheet with ease to suit the rooms.

It is yet another object of the present disclosure to provide a method of making an interchangeable hem/flange which is simple, cost effective and wherein the process is not time consuming.

It is another object of the present disclosure to provide a clothing arrangement with an interchangeable hem/flange portion for an article such as bed sheets, pillows, duvet covers, shams or the like.

SUMMARY OF THE DISCLOSURE

Thus according to the basic aspect of the present disclosure there is provided a method of introducing a hem/flange portion for an article such as bed sheets, pillows, duvet covers, shams or the like wherein the improvement comprising:

- constructing the base sheet of the article separately;
- constructing the hem/flange portion with or without design element of the said article separately; and
- attaching the said base sheet and the said hem/flange portion of the said article by attaching means,
- wherein the said attaching means includes zippers, snap buttons, regular buttons or the like,
- wherein the said base sheet and the said hem/flange portion of the said article can be attached to or removed from each other whenever necessary.

It is further aspect of the present disclosure, wherein the said method is adapted to provide multiple hem/flange attachments including color options, embroidery options etc such that any of the hem/flange portions can be attached with different base sheet with ease to suit the rooms.

It is further aspect of the present disclosure, wherein said method is adapted to have the option of using different types of "hems"/"flanges" on the same base sheet of the bed sheets or pillow cases or duvets or shams or the like, said method is cost effective and less time consuming.

It is further aspect of the present disclosure there is provided a clothing arrangement with an interchangeable hem/flange portion for an article such as bed sheets, pillows, duvet covers, shams or the like comprising:

- a base sheet;
- a hem/flange portion with or without design element; and attaching means;
- wherein the said attaching means includes zippers, snap buttons, regular buttons or the like,
- wherein the said base sheet and the said hem/flange portion of the said article can be attached to or removed from each other whenever necessary.

The details of embodiments of the invention, its objects and advantages are explained hereunder in greater detail in relation to non-limiting FIGS. 4-7.

BRIEF DESCRIPTION OF THE ACCOMPANYING FIGURES

FIG. 1: illustrates different options of design element given to the bed sheet in the prior art;

FIG. 2: illustrates different options of design element given to the pillowcases in the prior art;

FIG. 3: illustrates different options of design element given to the duvet covers in the prior art;

DETAILED DESCRIPTION OF THE INVENTION

Embodiments of the disclosed detachable and interchangeable hem will now be described with reference to FIGS. 4-7. The present disclosure is directed to a simple, cost effective and less time consuming method of providing different types of hems/flanges with or without design elements on the base sheet of bed sheets or pillow cases (or duvets or shams) to provide variety and options. More preferably, the present invention is directed to a method of making a "hem"/"flange" separately and attaching the said hem/flange to the base bed sheet or pillow cases, duvet covers, shams etc.

Figure 7:
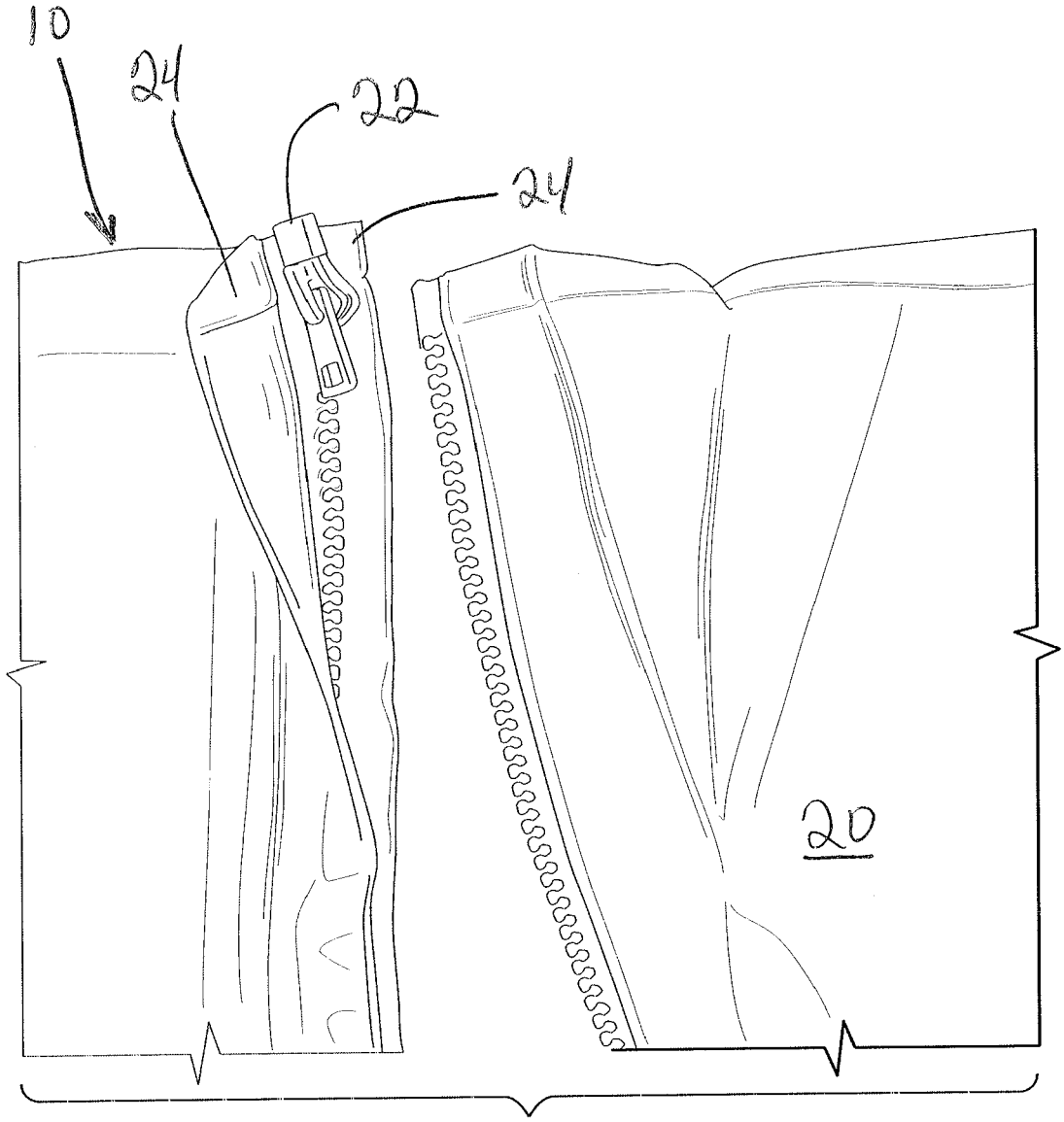
FIG. 7 is an enlarged partial view of the connection between a flat sheet and a removable and interchangeable hem/flange according to aspects of the present invention.

The top portion of a bed sheet is usually folded and hemmed in a slightly decorative manner to give the design element to the bed sheet. There are various ways of achieving this design element. With respect to duvets and shams the design element is attached over the product and the same is referred as "flange". The present disclosure thus provides the option of using different types of "hems"/"flanges" on bed sheets, pillow cases, duvets and shams to provide variety and decorative options in a manner which is not an expensive and time consuming. The base sheet 20 of article that includes bed sheets, pillows, duvet covers sham etc is constructed separately. The design element or the hem/flange portion 10 is constructed separately. These two portions (the hem 10 and the base sheet 20) are then individually fitted using attaching means 22 that includes zippers, snap buttons, regular buttons, Velcro, hook and loop fasteners, etc. FIG. 7 is an enlarged view of the connection between the base sheet 20 and the removable hem/flange 20. One or the other of the removable hem/flange 10 or the base sheet 20 includes one or more flaps 24 which cover the attachment means 22 to both hide the attachment means and provide a comfortable surface on the bedding article.

The present disclosure thus provides an interchangeable and detachable hem/flange 10 that can be easily attached to or removed from each other whenever necessary. Further the present disclosure provides multiple hem/flange attachments 10*a*, 10*b*, 10*c* including color options, embroidery options etc and any of these can be attached with the base sheet 20 of the article with ease.

It would be very useful to buy only a white sheet with the option of changing the hem/flange to different colors to suit the room or mood or to have a fully white sheet on day one and for the next day have a very detailed embroidery on the flat sheet and complement it with similar designs or colors for the pillow cases.

Figure 6:
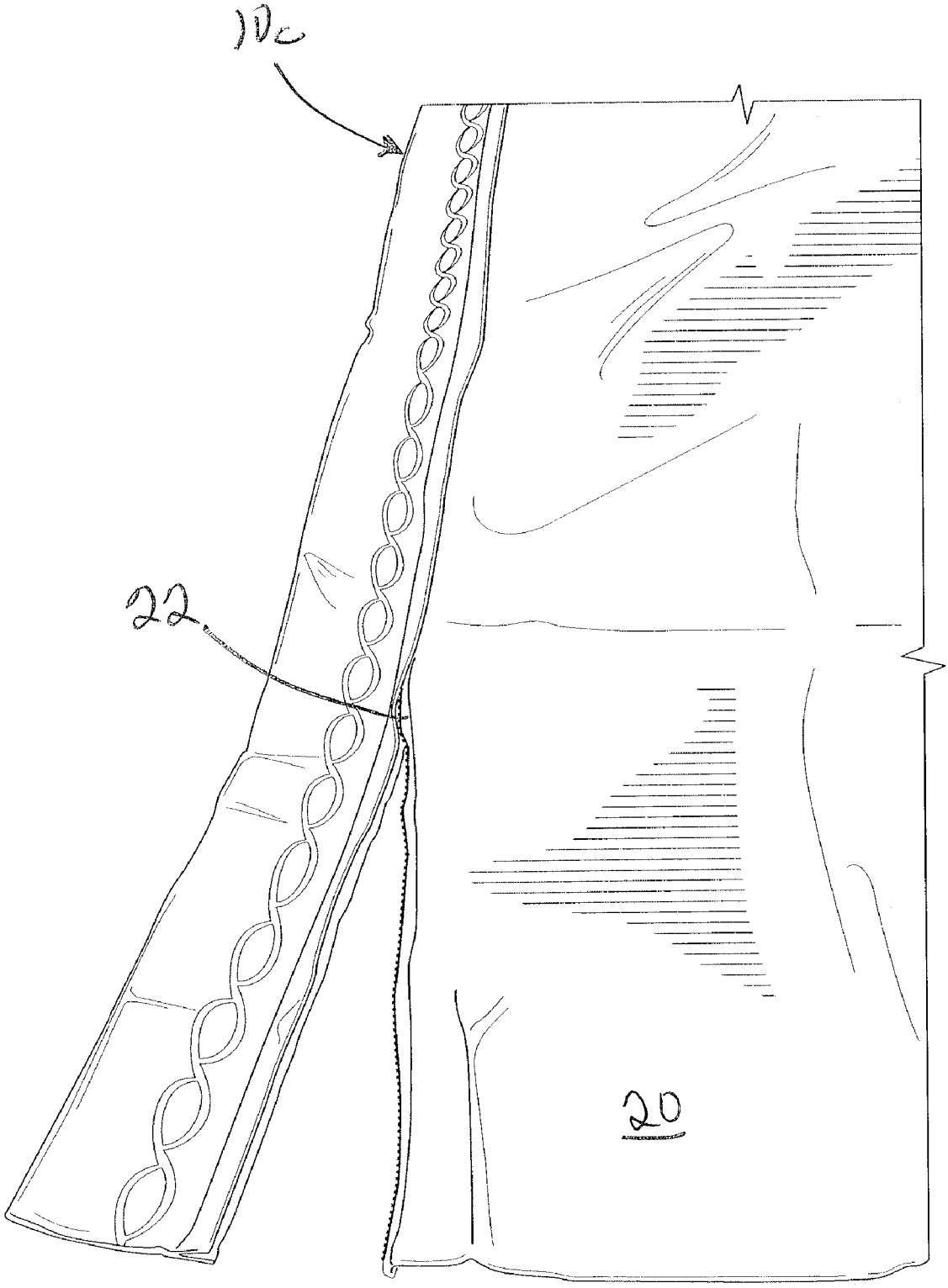
FIG. 6 illustrates a portion of a flat sheet incorporating a removable and interchangeable hem/flange according to aspects of the present invention.

An illustration of an embodiment of a bed sheet according to aspects of the invention is illustrated in FIGS. 6 and 7 and described as follows:

A bed sheet has a desirable finished size of 90"×108" with a 4" hem. The base sheet 20 is constructed separately which is to be around 86"×108" and the "hem" portion 10*c* is separately constructed as a 4"×108". (These sizes are approximate and indicate just the separation of these two portions. Depending on the construction, these may have overlapping sections also).

It is thus possible by way of the present disclosure to provide a simple, cost effective and less time consuming method of providing different types of hems/flanges 10 with or without design elements on the base sheet 20 of the bed sheets, pillow cases, duvets or shams and more specifically directed to a method of making a "hem"/"flange" 10 separately and attaching the said hem/flange 10 to the base bed sheet 20 or pillow cases, duvet covers, shams etc. Advantageously, the present disclosure provides multiple hems/flange attachments including color options, embroidery options etc such that any of the hem/flange portions can be attached with the base sheet 20 with ease to suit the rooms.

Figure 1:
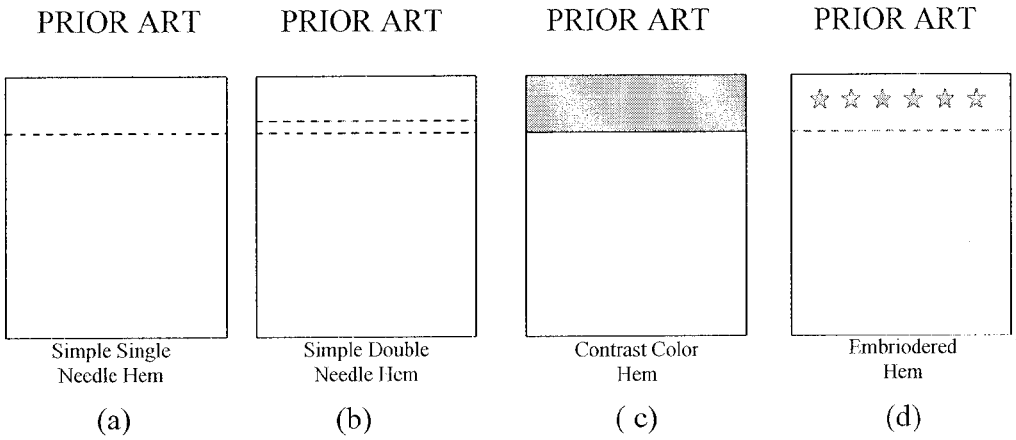
Figure 2:
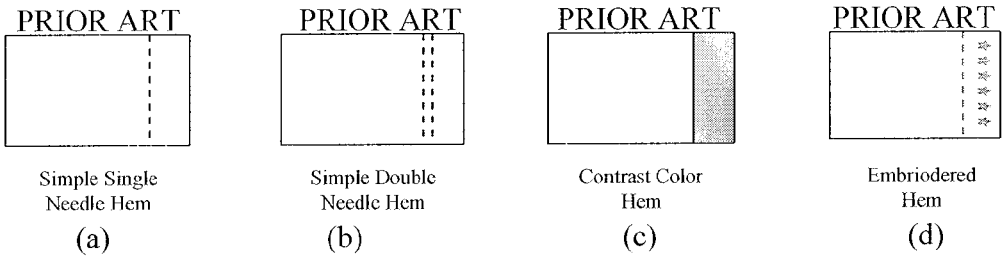
Figure 3:
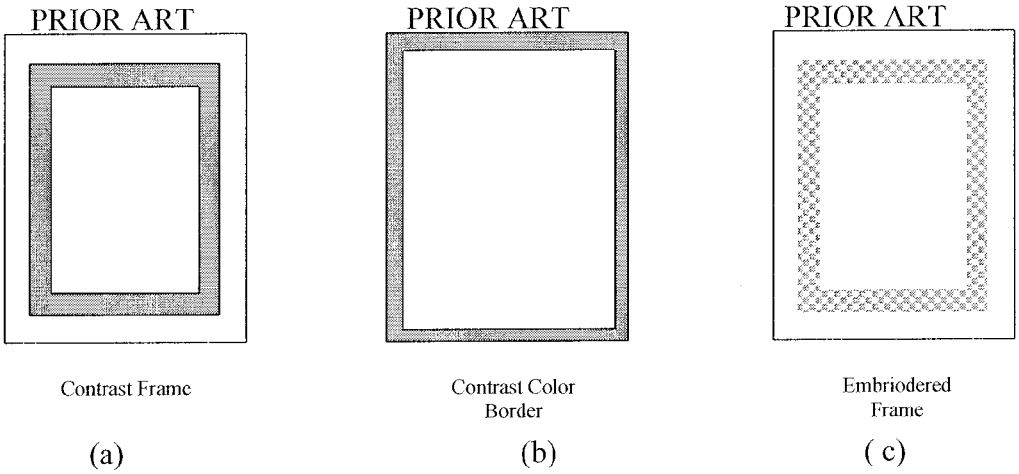
Figure 4:
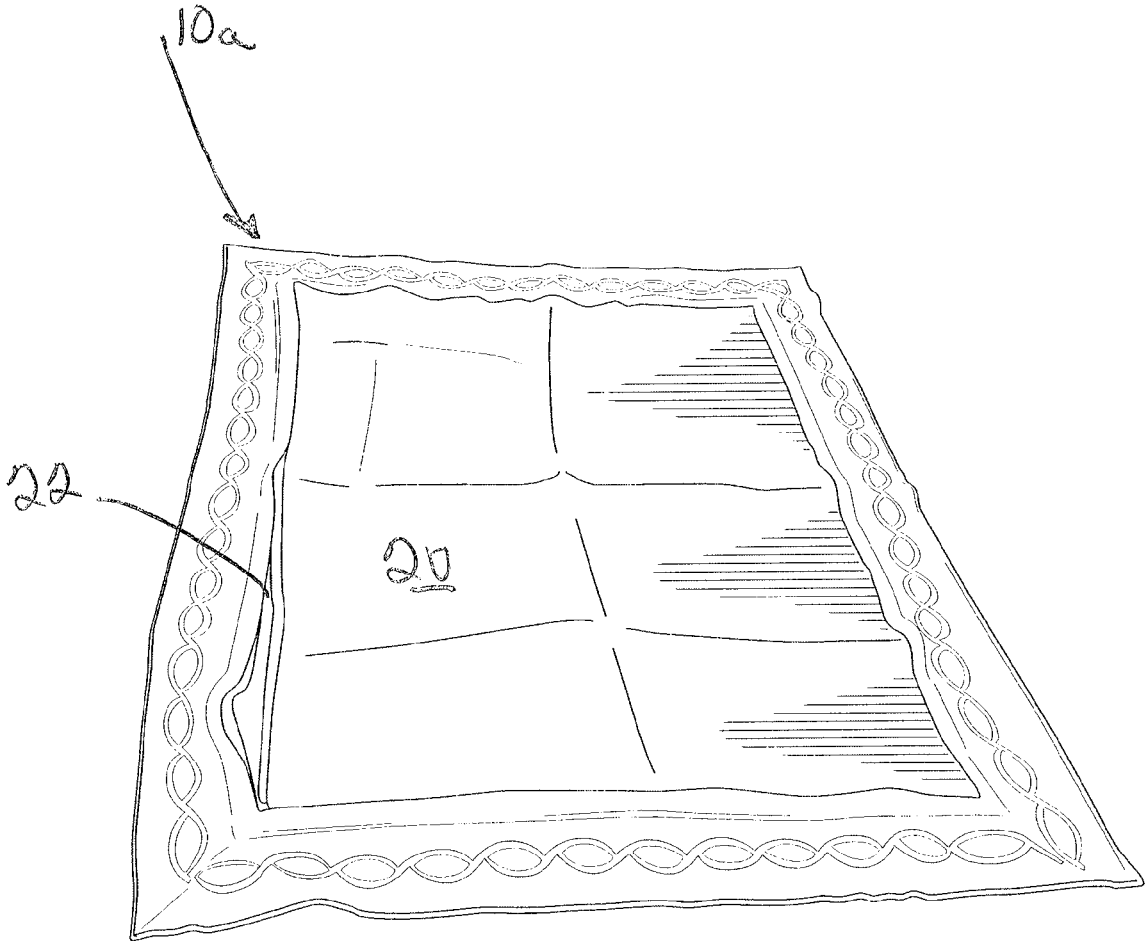
FIG. 4 illustrates a sham incorporating a removable and interchangeable hem/flange according to aspects of the present invention.

FIG. 4 illustrates a pillow sham base sheet 20 provided with a removable decorative hem/flange 10*a*. The decorative hem/flange 10 is removably joined to the sham base sheet 20 by attaching means 22 as described above.

Figure 5:
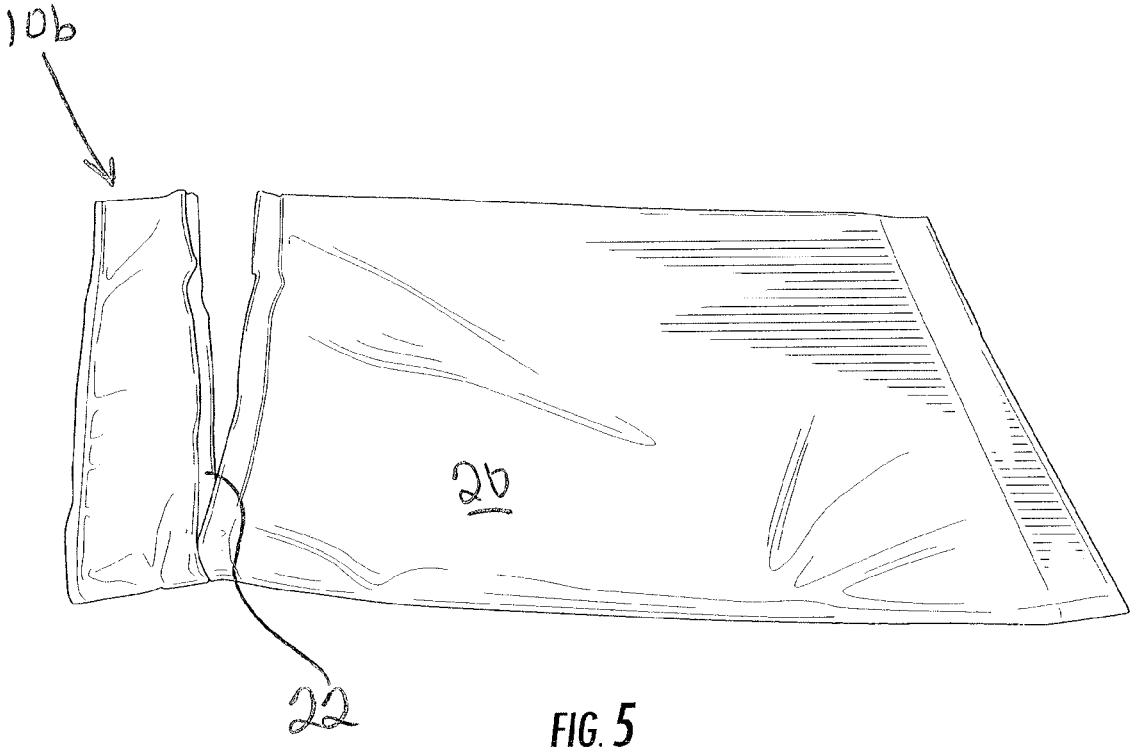
FIG. 5 illustrates a pillowcase incorporating a removable and interchangeable hem/flange according to aspects of the present invention.

FIG. 5 illustrates a pillow case base sheet 20 provided with a removable decorative hem/flange 10*b*. The decorative hem/flange 10 is removably joined to the pillow case base sheet 20 by attaching means 22 as described above.

It is to be appreciated that the foregoing is a description of several preferred embodiments of the invention to which variations and modifications may, be made without departing from the spirit and scope of the invention.

The invention claimed is:

1. A composite article of bedding comprising:

a base component including a first edge having a first length and defining at least a portion of the periphery of said base component, said first edge having first attaching means extending along substantially the entire said first length; and a hem/flange portion with a second edge having a second length substantially equal to said first length and a width less than one quarter of a width or a length of said base component, said second attaching means extending along substantially the entire second length and complementary to said first attaching means; and one of said first edge or second edge including a flap integrally connected to said base component or said hem/flange portion and configured to cover substantially all of said first and second attaching means when said hem/flange is connected to said base component by said attaching means, wherein said base component and said hem/flange portion of the article can be attached to or removed from each other whenever necessary, said hem/flange portion forming a border along said first edge of said base component.

2. The composite article of bedding of claim 1, wherein:

said base component is a closed geometrical shape having a periphery and said first edge extends around substantially the entire periphery of said base component, said hem/flange component is a border with a closed geometrical shape complementary to and surrounding said base component closed geometrical shape, said border having inside and outside edges, said second edge and second attaching means extending along said inside edge; and said base component and said border are connected by engaging said first attaching means with said second attaching means to form said composite article of bedding.

3. The composite article of bedding of claim 2, wherein said closed geometrical shape is a rectangle and said first attaching means, second attaching means and flap extend along all four sides of said rectangle.

4. The composite article of bedding of claim 1, wherein said attachment means includes zippers, buttons, hook and loop fasteners and snaps.

5. The composite article of bedding of claim 1, wherein:

said base component defines a pouch having an inside, an outside and an opening surrounded by said first edge;

said hem/flange portion is a hem complementary to said opening;

said flap extends outside said pouch; and said base component is attached to said hem by said attaching means to form said composite article of bedding.

6. The composite article of bedding of claim 1 comprising:

a plurality of hem/flange portions complementary to each said base component, each of said plurality of hem/flange portions having a color and/or decorative features different from the other of said plurality of hem/flange portions, wherein said hem/flange portions are interchangeably attachable to said base component to construct a plurality of composite articles of bedding having different decorative features.

7. A method of manufacturing a composite article of bedding having a base component and at least one hem/flange portion, said method comprising:

constructing the base component of the article to include a first edge having a first length and defining at least a portion of the periphery of said base component, said first edge having first attaching means extending along substantially the entire said first length;

constructing the hem/flange portion with a second edge having a second length substantially equal to said first length and a width less than one quarter of a width or a length of said base component, said second attaching means extending along substantially the entire second length and complementary to said first attaching means; and providing one of said first edge or second edge with a flap integrally connected to said base component or said hem/flange portion and configured to cover substantially all of said first and second attaching means when said hem/flange is connected to said base component by said attaching means, wherein said base component and said hem/flange portion of the article can be attached to or removed from each other whenever necessary, said hem/flange portion forming a border along said first edge of said base component.

8. The method of claim 7, wherein said attachment means includes zippers, buttons, hook and loop fasteners and snaps.

9. The method of claim 7, wherein said base component defines a pouch having an inside, an outside and an opening surrounded by said first edge and said method comprises:

configuring the hem/flange portion as a hem complementary to said opening;

constructing said flap to extend outside said pouch; and attaching said base component to said hem to form said composite article of bedding.

10. The method of claim 7 comprising:

providing a plurality of hem/flange portions with each said base component, each of said plurality of hem/flange portions having a color and/or decorative features different from the other of said plurality of hem/flange portions, wherein said hem/flange portions are interchangeably attachable to said base component to construct a plurality of composite articles of bedding having different decorative features.

11. The method of claim 7, wherein said base component is a closed geometrical shape having a periphery and said first edge extends around substantially the entire periphery of said base component, said step of constructing the hem/flange component includes:

configuring the hem/flange component as a border with a closed geometrical shape complementary to and surrounding said base component closed geometrical shape, said border having inside and outside edges, said second edge and second attaching means extending along said inside edge; and attaching said base component and said border by engaging said first attaching means with said second attaching means to form said composite article of bedding.

12. The method of claim 11, wherein said closed geometrical shape is a rectangle and said first attaching means, second attaching means and flap extend along all four sides of said rectangle.

* * * * *

UNITED STATES PATENT AND TRADEMARK OFFICE

CERTIFICATE OF CORRECTION

PATENT NO. : 8,011,038 B2
APPLICATION NO. : 12/794425
DATED : September 6, 2011
INVENTOR(S) : Sri Hari Prasadh Balasundharam It is certified that error appears in the above-identified patent and that said Letters Patent is hereby corrected as shown below:

Title Page
Item [30], Foreign Application Priority Data [priority info missing]

insert --[30] Foreign Application Priority Data April 6, 2009 India ..... 1319/CHE/2009--

Signed and Sealed this
Twenty-second Day of November, 2011

David J. Kappos
*Director of the United States Patent and Trademark Office*

UNITED STATES PATENT AND TRADEMARK OFFICE

CERTIFICATE OF CORRECTION

PATENT NO. : 8,011,038 B2
APPLICATION NO. : 12/794425
DATED : September 6, 2011
INVENTOR(S) : Sri Hari Prasadh Balasundharam It is certified that error appears in the above-identified patent and that said Letters Patent is hereby corrected as shown below:

Title Page
Item [30], Foreign Application Priority Data (priority info missing]

insert --[30] Foreign Application Priority Data June 4, 2009 India ..... 1319/CHE/2009--

This certificate supersedes the Certificate of Correction issued November 22, 2011.

Signed and Sealed this
Tenth Day of January, 2012

David J. Kappos

David J. Kappos
*Director of the United States Patent and Trademark Office*